United States Patent [19]

Guse

[11] 4,342,358

[45] Aug. 3, 1982

[54] CONTINUOUS CASTING INSTALLATION

[75] Inventor: Rudolf Guse, Ratingen, Fed. Rep. of Germany

[73] Assignee: Sack GmbH, Duesseldorf, Fed. Rep. of Germany

[21] Appl. No.: 118,403

[22] Filed: Feb. 4, 1980

[30] Foreign Application Priority Data

Jan. 31, 1979 [DE] Fed. Rep. of Germany ..... 2903540

[51] Int. Cl.[3] ..... B22D 11/128

[52] U.S. Cl. ..... 164/448; 198/860

[58] Field of Search ..... 164/442, 441, 447, 448; 198/860

[56] References Cited

FOREIGN PATENT DOCUMENTS 1957689 5/1971 Fed. Rep. of Germany .

589069 1/1978 U.S.S.R. ..... 164/448

*Primary Examiner*—Robert D. Baldwin

*Attorney, Agent, or Firm*—John J. Dennemeyer

[57] ABSTRACT

In a continuous casting installation, screw-less fixing of the roller guide segment frames to the bed is achieved by means of a plurality of traction rods which can be subjected to traction force by hydraulic means. Each traction rod has a nut thereon which is loadable by a respective ring piston guided in a self-adjusting manner in a semi-cylindrical bearing member supported on the bed. The free end of the traction rod is an apertured head aligned with frame apertures. A locking pin passing through said apertures releasably interconnects the rod and the segment frame.

7 Claims, 3 Drawing Figures

CONTINUOUS CASTING INSTALLATION

The invention relates to a continuous casting installation and, more particularly, to apparatus for fixing the cast rod guide segments containing the guide rollers of an arcuate continuous casting installation, to the base frame or bed of the continuous casting installation by means of a plurality of fixing pins.

It has been previously proposed to build a continuous casting installation in which the continuous casting mould is followed by a chill-mould lifter table which is supported on the frame of the casting stage. The actual rod guide frame, which is arranged within a cooling chamber, is supported on parts of the foundation or bed of the casting stage. The rod guide frame is divided into segments with a plurality of oppositely disposed upper and lower guide rollers or guide cylinders. The segments must be changed frequently for various reasons such as interchange of defective guide rollers, adjustment of the guide rollers to a different rod cross-section, etc., and are connected in this case to the base frames of the continuous casting installation by means of releasable screw or wedge connections (German Offenlegungsschrift No. 1 957 689).

However, it has been found to be disadvantageous that when the segments are screwed to the base frame, it is very difficult to replace them because the fixing screws are locked to the nuts during the operation of the installation—and this effect is increased further by the influence of the cooling water sprayed upon the rod—in such a manner that release of the nuts can be effected in most cases only by severing by means of autogenous cutting. Matters are rendered even more difficult in this case by the fact that the operating personnel must perform this work within the cooling chamber and therefore in a very cramped and dark space.

In the case of the wedge connection, a segment is clamped to the frame by means of a lever mounted on the base frame, and the clamping force is provided by a wedge which may be driven in by hand. The wedge is driven between the lever and a counter-member which is adjustable by means of an eccentric device and which forms the second abutment surface for the wedge, until sufficient clamping is attained. The wedge can then be released in that the counter-member of the wedge is swung back by means of the eccentric device. In this case, too, all the operations, such as rotation of the heavy lever, insertion of the wedge, adjustment of the eccentric device, must be performed in the cramped confines of the cooling chamber. A further disadvantage is that the clamping force—which is dependent upon various friction values and the strength of the operator—is never precisely determined. If the necessary clamping force has not been provided, the segment begins to "breathe" at the abutment faces, whereby, for example, scale can locate between the abutting surfaces causing lifting of the segment, whereby undesirable and uncontrollable forces influence the skin of the rod which is still partly very weak, leading occasionally to fracture of the rod.

An object of the invention is to avoid the disadvantages referred to above and to permit segment fixing which without severe physical exertion of the operating personnel permits absolutely secure clamping of the segments to the base frame of the continuous casting installation with a clamping force which can be accurately predetermined and at the same time directs the clamping force directly perpendicularly into the circular or circular arc-shaped base frame.

According to the present invention there is provided continuous casting apparatus comprising an arcuate bed, a cast rod guide of segmental construction mounted on said bed, each rod guide segment including a plurality of rod guide elements mounted in a frame, and multiple fixing means for releasably anchoring said frame to said bed, each fixing means comprising a first bore extending transversely in the bed, a second bore extending vertically in the bed between the first bore and said frame, a part-cylindrical bearing member fitted in the upper part of said first bore, a third bore extending through said bearing member in alignment with said second bore, a traction rod slidably mounted in said second and third bores and having projecting head and tail ends, corresponding apertures in said frame and said traction rod head end, a removable locking pin passing through said apertures to releasably interconnect the traction rod and the frame, a reaction member axially adjustably mounted on the tail end of the traction rod, biasing means for biasing the traction rod upwardly to bring the reaction member into abutting relation with the underside of said bearing member, and loading means for urging the reaction member away from the bearing member so as to exert an anchoring force on the rod guide segment frame through the traction rod.

Preferably, the loading means comprises an annular piston and cylinder device encircling said third bore and the reaction member is preferably a nut in screw-threaded engagement with the tail end of the traction rod.

Thus after a segment has been placed upon the bed of the continuous casting installation, the operating personnel need only push the locking pin into the rod head aperture for connecting-up the segment.

Securely clamping the segment is then effected by loading the ring cylinder formed in the part-cylindrical bearing member. In order to prevent leakage and fire risk, grease is preferably supplied to the cylinder by means of a pump, namely in such a manner that a clamping force is provided which is accurately determined in advance. After the insertion of the locking pin, the ring piston then pulls the segment which is coupled with the traction rod head in a defined manner downwards against the bed of the continuous casting installation, by way of the traction rod and the nut against which the ring piston acts. In this way the clamping force is introduced without deviation directly perpendicularly into the bed by virtue of the rotationally displaceable bearing member of semi-circular cross-section which is inserted in the transverse bore, since the bearing member together with the traction rod guided therein adjusts itself automatically to the positional changes caused by the circular or circular arc shape of the continuous casting installation and therefore the traction rod projects vertically from the base frame. Furthermore, because of the rotational displaceability of the semi-cylindrical bearing member, the traction rod is always free of bending moments, i.e. it is subjected only to tension, whatever displacements may occur in the system.

Although the aperture in the traction rod head is adjustable in height by means of the nut loaded by the ring piston, in order to adjust it to a position in line with the associated apertures in the guide segment frame, it is advisable to make the apertures in the traction rod heads larger than the apertures in the guide segment frames.

Conveniently the semi-cylindrical bearing members are secured axially by means of sealing covers which close the transverse bores in the base frame. Thereby the bearing for the semi-cylindrical pressure members and the displaceable ring piston are protected against external influences and are always capable of functioning.

One of the sealing covers supports a feed conduit for pressure grease which communicates with a conduit in the pressure chamber leading to the pressure chamber in the ring cylinder and is provided with a ventilation and non-return valve. In the event of segment change the pressure in the ring cylinder may be released selectively in the region of every traction rod, in order to permit removal of the associated locking pin.

It is also advantageous to operational reliability if the bores for guiding the locking pin are closed outwardly by covering hoods. In this case an actuator rod similar to a piston rod is guided out of a covering hood for the purpose of manipulating the locking pin. This ensures that the locking pin is always accessible for displacement.

The invention will now be further described by way of example only, with reference to the accompanying drawings, in which.

Figure 1:
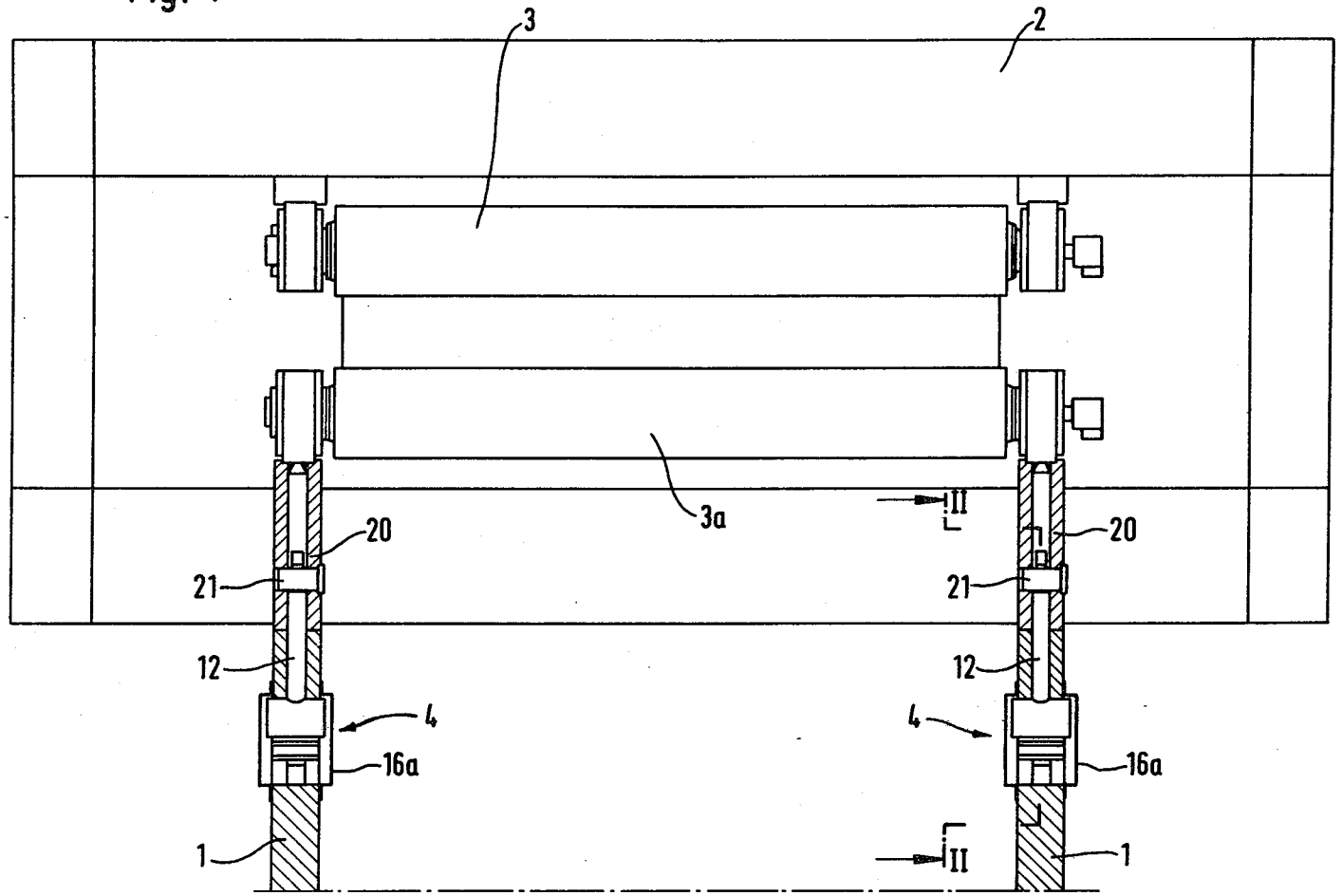
FIG. 1 is a diagrammatic, part-sectional view looking in the direction of travel of the cast rod of a cast rod guide segment fixed on a bed of one embodiment of continuous casting installation according to the invention.
Figure 3:
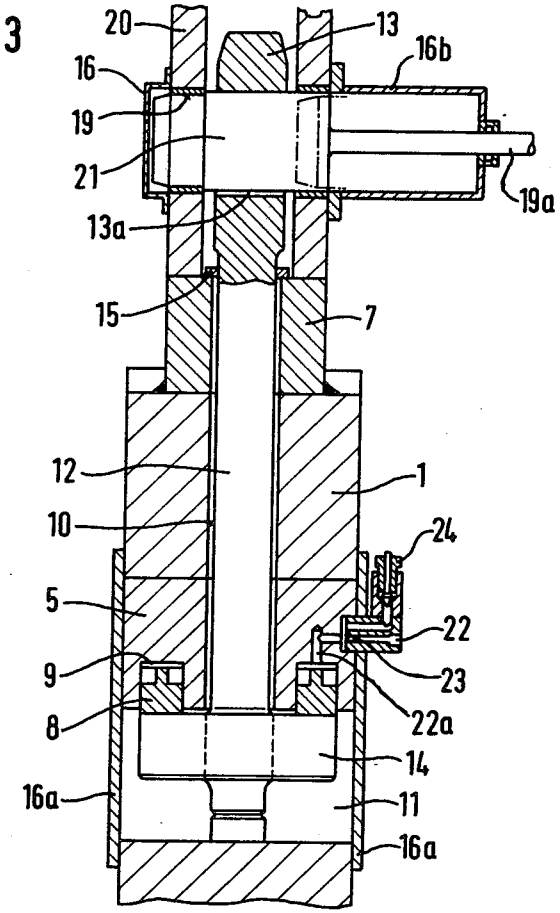
FIG. 3 is a section on the line III—III in FIG. 2.

FIG. 1 illustrates a frame-like cast rod guide segment 2 which is securely connected to the bed or base frame 1 of a continuous casting installation not illustrated in detail. In this case the rod guide proper of the continuous casting installation comprises a plurality of cast rod guide segments which contain a multiplicity of upper and lower guide rollers 3, 3*a* and which must be placed on and fixed to the base frame 1 one after the other in accordance with the circular arc-shape of a continuous casting installation. The base frame 1 forms the supporting sturcture. Preferably each rod guide segment 2 is fixed on each side on the base frame 1 at two fixing points spaced apart in the direction of travel of the cast rod, that is to say at a total of four locations.

Figure 2:
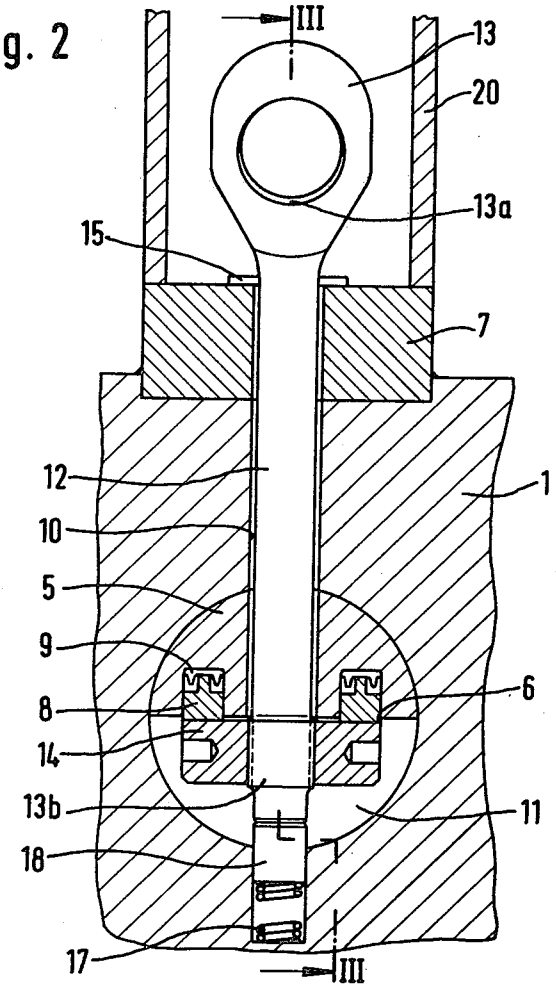
FIG. 2 is a section on the line II—II in FIG. 1, to an enlarged scale.

Each segment fixing means 4 (FIG. 1) comprises a semi-cylindrical bearing or pressure member 5 into the plane base face of which is machined a ring cylinder 6 in which a ring piston 8 is a sliding fit inserted and sealed with sleeves in such a manner that the ring piston 8 and the ring cylinder 6 enclose a pressure chamber 9 which is loadable by a pressure medium. Furthermore the semi-cylindrical pressure member 5 comprises a through-bore which is central in relation to the ring cylinder 6, and is inserted in a transverse bore 11 of the base frame 1. A traction rod 12 has a head 13 with an aperture 13*a* and projects from the base frame 1 through the through-bore of the semi-cylindrical pressure member 5. The tail end 13*b* (FIG. 2) of the rod is provided with a screw-thread and has a nut 14 screwed thereon which serves as an abutment for the ring piston 8. Moreover the traction rod 12 is secured against rotation by a seal and guide element 15 in the region of the issue from the base frame 1 or an attachable member 7. Altogether all the chambers which receive machined and displaceable apparatus components are closed by releasable sealing covers or hoods 16, 16*a* and 16*b*.

The abutment nut 14 is accessible by removing one of the sealing covers 16*a* which close the transverse bore 11 and secure the semi-cylindrical pressure member 5 in an axial direction.

The displaceability of the pressure member 5 because of its semi-cylindrical abutment surface in the transverse bore 11 and a through-bore 10 in the base frame 1 which is larger in diameter than the diameter of the traction rod 12 permits the ring piston 8 always to lie against the nut 14 without tilting and the traction rod is thus not subjected to bending stress. It is therefore unnecessary to provide the arcuate base frame with milled-in respective seating faces for tensioning nuts for all fixing bolts, which seating faces would have to extend exactly transversely to the bolts which owing to the arcuate form of the base frame cannot be parallel to each other. Moreover each fixing apparatus 4 is encapsulated and far removed from the hot region of the cast rod guide proper, so that the remotely controlled actuation of the fixing apparatus by means of the pressure generation in the pressure chambers 9, or the relief thereof, is functionally very reliable.

The manner of operation of the fixing apparatus described is as follows:

In the relieved position, i.e. when the pressure in the ring cylinder 6 has been removed, a spring 17 presses either directly against the lower free end face of a traction rod 12 or by way of an intervening piston 18 (FIG. 2) which presses the nut 14 together with the traction rod 12 continuously upwardly against the base face of the semi-cylindrical pressure member 5. In this case the spring 17 is so strong that the traction rod 12 is reliably lifted to an extent limited by the nut 14. In this position, which is the assembly position for a ledge-like frame member 20 of a cast rod guide segment 2, the traction rod 12 projects from the base frame 1 to such an extent that after the deposition of the frame member 20 upon the base frame 1 or an attachable member 7, respectively, the traction rod head 13 with the traction head apertures 13*a* is aligned with a corresponding bore 19 of the segment frame member 20. If necessary, the position of the aperture 13*a* is adjusted by adjustment of the nut 14. As soon as this position has been attained, a locking pin 21 is pushed through the aperture 19 of the segment frame member 20 and through the rod head bore 13*a* for the purpose of coupling the segment frame member 20 to the base frame 1. This is effected without great effort, since the locking pin 21 has sufficient play in relation to the bores 13, 13*a*. An actuator rod 19*a* similar to a piston rod extends out of the sealing hood 16*b* for the purpose of facilitating displacement of the locking pin 21.

After the locking pin 21 has been pushed in, the ring cylinder 6 is loaded, preferably with grease, at a pressure which has been accurately determined in advance, by means of a pressure-controlled grease pump which is not illustrated and which can be connected to a nipple 22 of the feed conduit 22*a* to the ring cylinder 6. As the loading of the pressure chamber 9 of the ring cylinder 6 increases, the traction rod 12 and the nut 14 screwed thereon against which the ring piston 8 acts, is pulled downwards in a defined manner and thereby the segment is secured to the base frame of the continuous casting installation by way of the ledge-like segment frame members 20 and the locking pin.

A non-return valve 23 built into the grease feed conduit 22*a* prevents a pressure drop in the ring cylinder 6 which is continuously subjected to pressure, in case a pipeline fractures. When a segment is changed, the pressure in the ring cylinder 6 can be released by means of a ventilation valve 24 or by means of an unlockable non-return valve or the like.

Without further analysis, the foregoing will so fully reveal the gist of the prevent invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

What is claimed is:

1. Continuous casting apparatus comprising an arcuate bed, a cast rod guide of segmental construction mounted on said bed, each rod guide segment including a plurality of rod guide elements mounted in a frame, and multiple fixing means releasably anchoring said frame to said bed, each fixing means comprising a first bore extending transversely in the bed, a second bore extending vertically in the bed between the first bore and said frame, a part-cylindrical bearing member fitted in the upper part of said first bore, a third bore extending through said bearing member in alignment with said second bore, a traction rod slidably mounted in said second and third bores and having projecting head and tail ends, corresponding apertures in said frame and said traction rod head end, a removable locking pin passing through said apertures to releasably interconnect the traction rod and the frame, a reaction member axially adjustably mounted on the tail end of the traction rod, biasing means for biasing the traction rod upwardly to bring the reaction member into abutting relation with the underside of said bearing member, and loading means for urging the reaction member away from the bearing member so as to exert an anchoring force on the rod guide segment frame through the traction rod.

2. Apparatus as claimed in claim 1, wherein the loading means comprises an annular piston and cylinder device encircling said third bore.

3. Apparatus as claimed in claim 1 or 2, wherein the reaction member is a nut in screw-threaded engagement with the tail end of the traction rod.

4. Apparatus as claimed in claim 1, wherein the aperture in the traction rod head is larger than the corresponding frame aperture.

5. Apparatus as claimed in claim 1, wherein the bearing member is axially secured by sealing end covers which close the first bore.

6. Apparatus as claimed in claim 5, wherein one of the sealing covers supports a feed conduit for pressure grease which communicates with a conduit in the bearing member leading to the pressure chamber of the annular cylinder and which is provided with a ventilation and non-return valve.

7. Apparatus as claimed in claim 1 or 4, wherein the frame apertures are covered by hoods and an actuator in the form of a piston rod extends out of one of said hoods to facilitate displacement of the locking pin.

* * * * *